United States Patent [19]

Westfall et al.

[11] Patent Number: 4,800,680

[45] Date of Patent: Jan. 31, 1989

[54] CORD GUIDE SYSTEM FOR SASH BALANCE

[75] Inventors: Norman R. Westfall, Rochester; Patrick E. Milligan, Kendall; John I. Habbersett; Brian S. Dense, both of Rochester, all of N.Y.

[73] Assignee: Caldwell Manufacturing Company, Rochester, N.Y.

[21] Appl. No.: 85,378

[22] Filed: Aug. 14, 1987

[51] Int. Cl.[4] ..... E05D 13/00

[52] U.S. Cl. ..... 49/429; 16/198; 16/214; 49/431

[58] Field of Search ..... 16/196, 198, 197, 210, 16/214; 49/429, 430, 431, 445

[56] References Cited

U.S. PATENT DOCUMENTS

| | | | |
|---|---|---|---|
| 2,774,119 | 12/1956 | Osten . | |
| 3,078,523 | 2/1963 | Martin | 16/197 X |
| 3,146,488 | 9/1964 | Dahlstrom | 16/191 |
| 3,290,825 | 12/1966 | Adams | 49/431 |
| 3,358,403 | 12/1967 | Dinsmore . | |
| 4,134,234 | 1/1979 | Wood . | |

*Primary Examiner*—Joseph Falk

*Attorney, Agent, or Firm*—Stonebraker, Shepard & Stephens

[57] ABSTRACT

A block and tackle balance system (10), contained within a spring cover (12) extending for the full length of a jamb liner (11), includes a guide (30) that directs a cord (25) through an angled course as it passes from the balance (20), through a hole (13) in the spring cover, to a support that moves up and down with a sash (15) outside the spring cover. The passing of the cord through the angled course in the guide produces load-related friction that helps prevent hop and drop of the sash. Guide (30) also preferably supports an end of the balance within the spring cover, and a support (50, 60) on the free end of cord (25) preferably engages sash (15) automatically as the sash assembled between a pair of jamb liners (11).

24 Claims, 3 Drawing Sheets

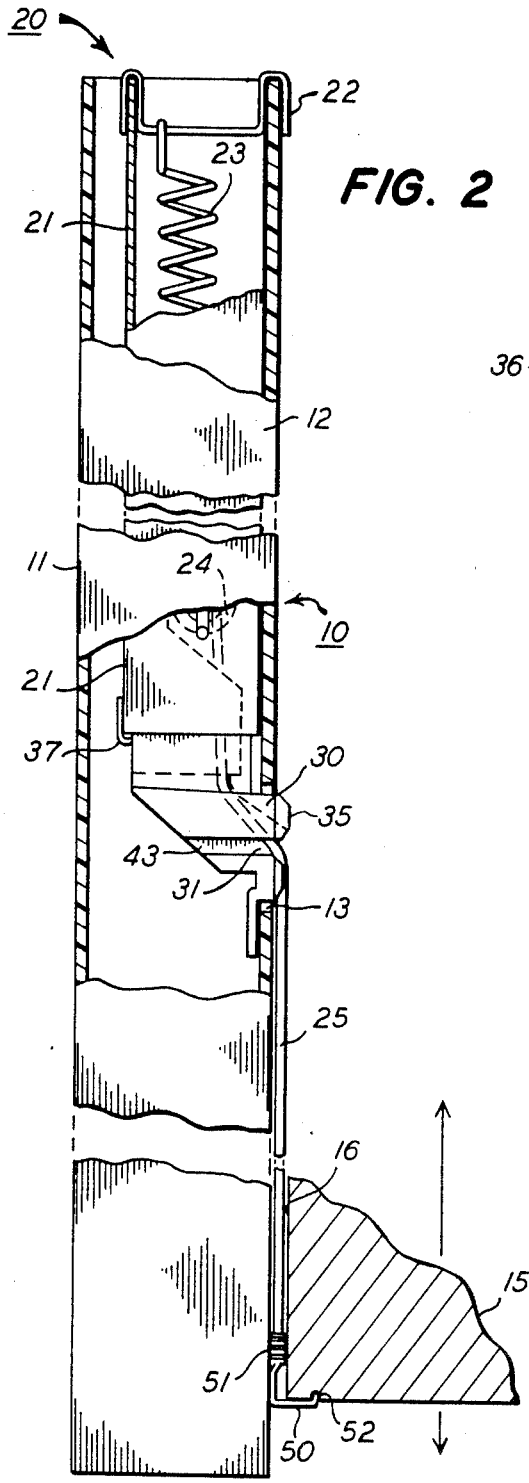
FIG. 2
FIG. 3
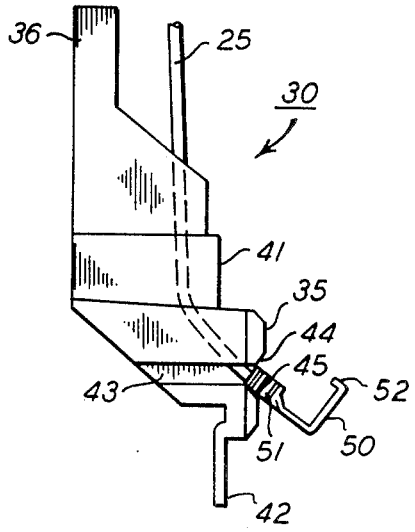
FIG. 3A
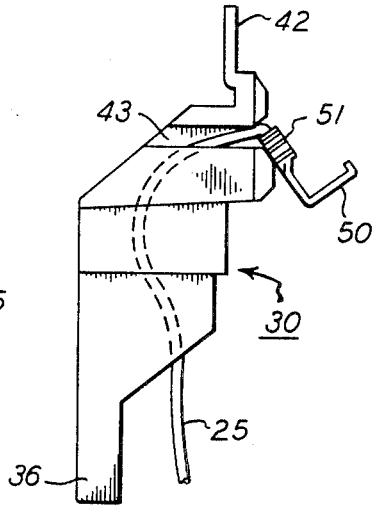

CORD GUIDE SYSTEM FOR SASH BALANCE

BACKGROUND

Spring covers for jamb liners of non-take-out windows occupy only the upper half of the sash run. Platforms engaging the lower corners of a sash are then free to move up and down in the lower half of each jamb liner, where no spring covers occur. The requirement for half-length spring covers in these systems is more expensive than extruding or forming the jamb liners as a single piece with a full-length spring cover.

There have been some suggestions for full-length spring covers enclosing block and tackle balance systems from which a cord runs outside the spring cover to engage a sash. None of these have been in commercial use, so far as applicants are aware. The Wood U.S. Pat. No. 4,134,234 is an example of this, and Wood suggests a block and tackle balance extending for the full length of the jamb liner, with the cord passing from the top of the jamb liner downward through a long open slot in a check rail region of the jamb liner. Dinsmore U.S. Pat. No. 3,358,403 and Osten U.S. Pat. No. 2,774,119 suggest other arrangements of block and tackle balances deploying cords or tapes that extend through a spring cover to engage a sash.

We have improved on such systems by devising a guide that guides a cord through the spring cover so as to provide load-related friction helping to prevent hop and drop of the balanced sash. Our guide also closes the necessary opening in the spring cover, helps anchor the balance system within the spring cover, helps anchor the balance system with the spring cover, and helps deploy a platform where it will automatically engage a sash assembled into position between a pair of jamb liners. Our improvement also includes better supports attachable to a free end of the cord for engaging the bottom of a balanced sash. All these improvements aim at economy, efficiency, durability, reliability, and weather sealing.

SUMMARY OF THE INVENTION

Our sash balance system uses a block and tackle balance arranged within a spring cover extending the full length of a jamb liner. It includes a cord guide extending through an opening in the jamb liner to guide a cord from a lower region of the balance through the opening to a sash support that is vertically movable outside the spring cover. The guide has a cord slot that directs the cord through an angled course, as the cord passes through the opening, to create a friction load as a function of the force of the balance and the weight of a sash on the support. The cord guide preferably connects to an end of the balance and snap fits into the opening in the spring cover. A sash support, arranged on a free end of the cord, is deployed for automatically engaging and supporting a sash assembled between a pair of jamb liners.

DRAWINGS

FIG. 2 is a partially cutaway, cross-sectional view taken along the line 2—2 of FIG. 1 and showing one spring cover provided with our balance system.

FIG. 3 is a side elevational view of a guide block from the balance system of FIG. 2, showing a sash support deployed for engaging a sash.

FIG. 3A is a side elevational view of a guide block similar to the guide block of FIG. 3, but inverted to accommodate a balance system arranged in a lower half of a spring cover.

DETAILED DESCRIPTION

Figure 1:
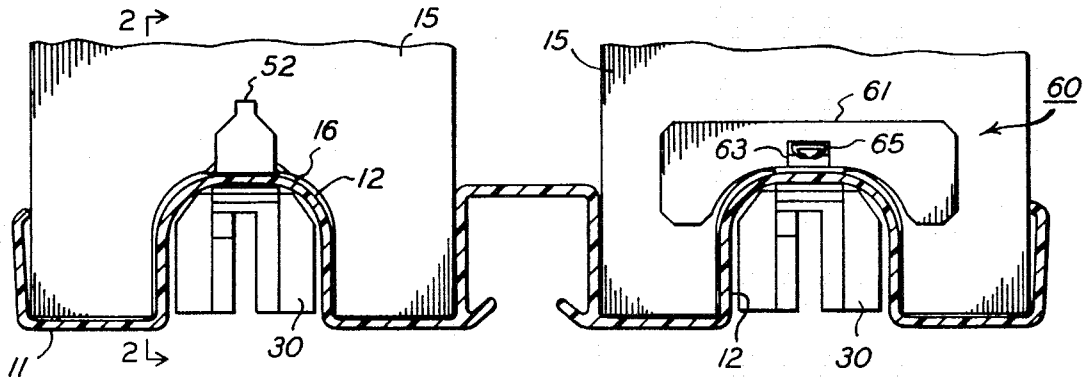
FIG. 1 is a cross-sectional view of a jamb liner, looking upward at the bottoms of a pair of sashes supported in alternative ways and balanced according to our invention.
Figure 8:
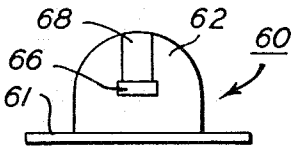
FIG. 8 is a bottom or inside view of the support of FIG. 7.
Figure 7:
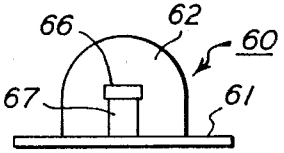
FIG. 7 is a top or outside view of an alternative preferred sash support for our balance system.
Figure 10:
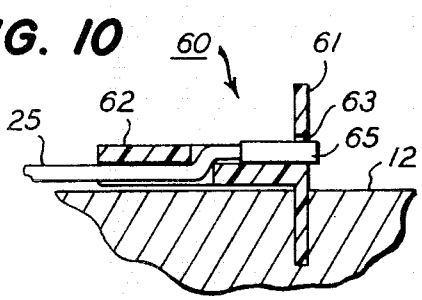
FIG. 10 is a partially cutaway side elevational view of the support of FIG. 9, showing the cord crimp interlocked with the support.
Figure 9:
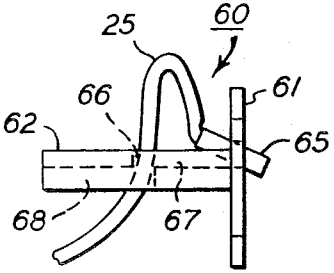
FIG. 9 is a side elevational view of the support of FIGS. 7 and 8, showing how a cord with an end crimp is threaded into the support.
Figure 4:
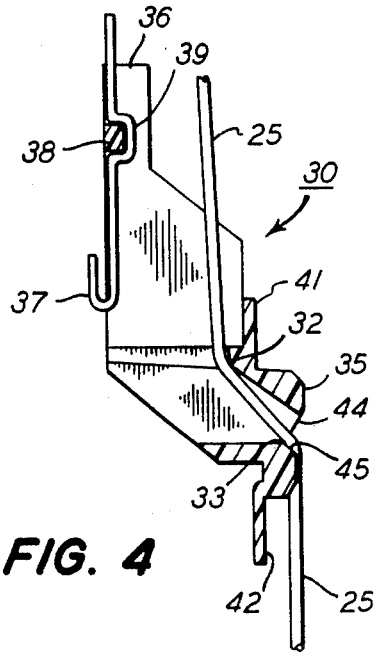
FIG. 4 is a cross-sectional view of the guide block of FIG. 3, showing an interlock with a pulley clip of the balance system and showing how the cord is guided through a guide slot in the block.
Figure 6:
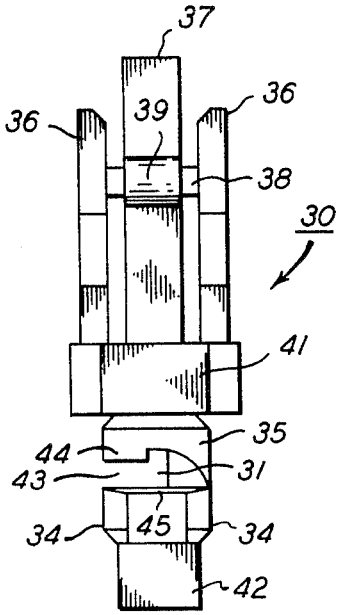
FIG. 6 is a plan view of the guide block of FIGS. 3 and 4.
Figure 5:
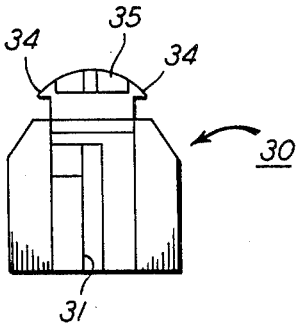
FIG. 5 is a bottom end elevational view of the guide block of FIGS. 3 and 4.

Our balance system 10 applies to a jamb liner 11 having a full-length spring cover 12. Jamb liner 11 can be formed of metal or extruded of resin, which we prefer, and a pair of jamb liners 11 support opposite stiles of a sash 15 having a plough region 16 that loosely fits around spring cover 12. Sash 15 moves vertically in a run that includes spring cover 12, and jamb liner 11 can accommodate one or two sashes 15. For convenience of illustration, the sashes 15, as shown in FIG. 1, are supported by two different forms of supports, as explained more fully below.

To counterbalance sash 15, a block and tackle balance 20 is mounted in spring cover 12, where balance 20 is contained within a channel 21. We prefer mounting balance 20 in the upper half of spring cover 12, as illustrated in the drawings; but it is also possible to mount balance 20 in the lower half of spring cover 12, as explained below. A clip 22 hooks over an upper end of channel 21 and supports an upper end of balance spring 23 to bear the spring load. For the illustrated mounting of balance 20 in the upper half of spring cover 12, clip 22 also extends over the top of spring cover 12 to anchor the upper end of balance 20 in place within spring cover 12. A lower region of balance 20 has a generally known block and tackle system that includes a cord 25. A cord guide 30 directs cord 25 from the lower end of balance 20 in a path that leads from inside spring cover 12 to outside of spring cover 12. Support hook 50, crimped on the free end of cord 25, supports a lower region of the stile of sash 15 adjacent plough region 16. The force of spring 23, in elongating a short distance, is spread by the block and tackle system over a longer distance that cord 25 can travel outside of spring cover 12 as sash 15 raises and lowers, as indicated by the arrow.

In our balance system 10, guide 30 performs several important functions, one of which is to produce load-related friction to prevent hop or drop of the balanced sash. Guide 30 is preferably injection molded of resin and includes a cord-guiding slot that directs cord 25 through an angled course as it passes through head 35 of guide 30. With balance 20 mounted in the upper half of spring cover 12, as illustrated, the angled course preferably includes two angles that occur where cord 25 is tensioned around two corners 32 and 33, which have small radii and are smoothly formed.

Each angle preferably diverts cord 25 about 50° off course, but these angles can vary widely in practice. The two angles not only direct cord 25 from inside of spring cover 12 to outside of spring cover 12, but also produce a load-related friction as cord 25 moves around corners 32 and 33. The double angled course also directs cord 25 downward from balance 20 and downward from guide 30 to engage a lower corner of sash 15.

The greater the force of spring 23 and the greater the weight of sash 15, the more tension is applied to cord 25. In turn, the greater the tension on cord 25, the larger is the friction that cord 25 produces in rounding corners 32 and 33. This makes the cord friction load-related and adds the cord friction to the block and tackle friction and the sash friction in jamb liner 11. Also, since the friction of cord 25 in passing through the angled course is related to the working load, this friction is larger for stronger springs 23 and heavier sash 15, as is appropriate for preventing hop and drop under larger loads.

Guide 30 also fits into the lower end of channel 21, carrying the block and tackle balance 20. Guide 30 has a pair of legs 36 that fit within the side edges of channel 21 and straddle a clip 37 that hooks over the lower end of channel 21 and supports some of the pulleys of balance 20. A cross-bar 38, between legs 36, fits under a hump 39 in clip 37 to anchor guide 30 in the lower end of balance 20.

Head 35 of guide 30 snap fits into hole 13 in the check rail region of spring cover 12. For this purpose, side flanges 34 of head 35 are wider than hole 13 and shaped for snap fitting into hole 13. This anchors the lower end of balance 12 within spring cover 12.

To close the longitudinal length of hole 13, guide 30 has a shoulder 41 extending upward from head 35 and a flange 42 extending downward from head 35, inside spring cover 12. These block air flow into spring cover 12 through hole 13; and since spring cover 12 extends for the full length of jamb liner 11 and is substantially closed by a window frame at its upper and lower ends, air cannot enter spring cover 12 and move vertically in a chimney effect that has been a problem with half-length spring covers.

The cord guide slot 31 in guide 30 preferably has a lateral opening 43 that allows cord 25 to be laterally reeved into slot 31, without having to be threaded through guide 30. This allows quick assembly of guide 30 onto cord 25 as guide 30 is mounted in the lower end of balance 20.

At the output end of cord-guiding slot 30 in head 35, surfaces 44 and 45 are beveled and made oblique to spring cover 12 and the general direction of travel of cord 25. Oblique surfaces 44 and 45 deploy hook 50 to extend obliquely away from spring cover 12, as shown in FIG. 3, where hook 50 automatically engages the bottom of sash 15 next to plough region 16. This occurs when sash 15 is lowered into engagement with an opposed pair of hook supports 50 between an opposed pair of jamb liners 11, as a window is assembled. Hook 50 has a sleeve 51 crimped onto the free end of cord 25, and sleeve 51 engages oblique surfaces 44 and 45 to dispose hook 50 at the desired oblique angle. The tip 52 of hook 50 is then disposed to catch the bottom of the stile of sash 15 in a region spaced from plough 16 to interlock with the end grain of the sash stile and support a lower corner of sash 15.

An alternative support 60 for sash 15 is shown in FIGS. 1 and 7–10. To interlock with support 60, the free end of cord 25 has a crimped-on sleeve 65, similar to a shoelace tip. Since sleeve crimp 65 cannot bend, it interlocks cord 25 with support 60 as shown in FIGS. 7–10.

A platform 61 of support 60 preferably has a curved shape that fits around spring cover 12, as shown in FIG. 1, and an anchoring arm 62 that extends away from platform 61, as shown in FIGS. 7–10. Anchoring arm 62 has a hole 66 through which cord 25 and end crimp 65 can be threaded. The upper or outward facing side of anchoring arm 62 preferably has a crimp channel 67 extending to a hole 63 in platform 61, and the bottom or inside of anchoring arm 62 preferably has a cord channel 68 positioned to accommodate cord 25.

Attaching support 60 to the free end of cord 25 only requires threading crimp 65 through hole 66 and then inserting crimp 65 through hole 63 in platform 61. Then the tension on cord 25 pulls crimp 65 into channel 67 while cord 25 bends through hole 66 and lies in channel 68. Since crimp 65 is held in hole 63 in platform 61, it cannot bend to round the corner as required to pass through hole 66 and is thus interlocked with support 60. Also, platform 61 is large enough to straddle and overlap the plough region 16 of sash 15 so that sash 15 automatically comes to rest on platform 61.

Either support 50 or 60 engages a lower corner of a sash 15 and moves vertically outside of spring cover 12 as the sash is raised and lowered. Both supports 50 and 60 also automatically engage with sash 15, so that no attachment or interconnection is necessary with sash 15.

When balance 20 is inverted and arranged in a lower half of spring cover 12, guide 30 can be attached in a similar way to the upper end of balance 20 and can fit into hole 13 in the check rail region of spring cover 12 to support the upper end of balance 20. In this inverted position, as shown in FIG. 3A, cord 25 passes through an angled course that turns it from an upward direction to a downward direction as cord 25 passes through guide 30. Such a U-turn, angled course of cord 25 through guide 30 can also accommodate hook support 50 or platform support 60, properly oriented to engage a lower corner of sash 15, and move downward from guide 30. The U-turn also provides friction as a function of the force of spring 23 and the weight of sash 15, to prevent hop or drop of the sash.

We claim:

1. In a sash balance system for a non-take-out window using a block and tackle balance arranged within a jamb liner spring cover and having pulleys and a cord for counterbalancing a sash running in said jamb liner and having a plough region extending around said spring cover, the improvement comprising:

a. a sash support connected to a free end of said cord and movable vertically outside of said spring cover to support said sash;

b. a guide fixed in a hole in said spring cover for guiding said cord from an end of said balance through said spring cover to said sash support;

c. said guide having a cord slot that directs said cord around a pair of radiused corners as said cord passes through said hole in said spring cover so that passage of said cord around said corners in said slot creates a friction load as a function of the force of said balance and the weight of said sash on said support; and d. said spring extending for the full length of said jamb liner, and said plough region of said sash clearing said spring cover sufficiently to allow said cord to run outside of said spring cover, within said plough region.

2. The improvement of claim 1 wherein said guide has lateral shoulders that snap fit into said hole in said spring cover and longitudinal flanges that close said hole.

3. The improvement of claim 2 wherein said hole is located in a check rail region of said spring cover.

4. The improvement of claim 2 wherein said guide is attached to an output end of said balance.

5. The improvement of claim 1 wherein said guide has a surface adjacent an output region of said cord slot and oblique to said spring cover to dispose said sash support at an outwardly extending angle for automatically engaging said sash when said sash is lowered onto said support.

6. The improvement of claim 5 wherein said sash support is a hook crimped onto said free end of said cord to engage a stile of said sash adjacent said plough region of said sash.

7. The improvement of claim 1 wherein said cord slot opens laterally of said guide so that said cord can be laterally reeved through said slot while said support is attached to said cord.

8. The improvement of claim 1 wherein said sash support spans said plough region of said sash.

9. The improvement of claim 8 wherein said sash support has a passageway that interlocks with a sleeve crimped on said free end of said cord.

10. A guide and spring cover for guiding a cord from a block and tackle window balance arranged within said spring so that said cord passes through an opening in said spring cover to support a non-take-out sash, said guide and spring cover comprising:

a. a resin guide body connected to an end of said balance;

b. said body having a head extending through and fixed in said opening in said spring cover; and c. said body having a cord-guiding slot extending from an entry accessible from said balance within said spring cover to an exit in said head outside said spring cover, said slot being formed to guide said cord around a pair of radiused corners as said cord passes through said spring cover.

11. The guide and spring cover of claim 10 wherein said cord guiding slot has a lateral opening, allowing said cord to be laterally reeved into said slot.

12. The guide and spring cover of claim 10 wherein said head has lateral shoulders that snap fit into said opening.

13. The guide and spring cover of claim 10 wherein said head has flanges extending longitudinally to close said opening.

14. The guide and spring cover of claim 10 wherein said head has a surface adjacent said cord-guiding slot and oblique to said spring cover to deploy a sash support on a free end of said cord to extend obliquely from said head for automatically engaging said sash when said sash is lowered onto said support.

15. A sash balance system comprising:

a. a block and tackle balance arranged within a spring cover that extends the full length of a jamb liner;

b. a cord guide extending through and fixed in an opening in said spring cover to guide a cord from an end of said balance inside said spring cover through said opening;

c. a free end of said cord being connected to a sash support outside said spring cover; and d. said cord guide having a cord slot that directs said cord around a pair of radiused corners, as said cord passes through said opening, to create a friction load as a function of the force of said balance and the resistance tension applied to said cord by said sash support.

16. The system of claim 15 wherein said guide has a lateral opening to said cord slot, allowing said cord to be laterally reeved into said slot.

17. The system of claim 15 wherein said guide has lateral shoulders that snap fit into said opening and longi- tudinal flanges that close said opening.

18. The system of claim 15 wherein said opening is located in a check rail region of said spring cover.

19. The system of claim 15 wherein said cord guide is attached to said end of said balance.

20. The system of claim 15 wherein said sash support is a hook crimped onto a free end of said cord.

21. The system of claim 20 wherein said cord guide has an oblique surface adjacent an exit region of said cord slot to dispose said hook at an outwardly extending angle.

22. The system of claim 21 wherein a region of said hook that is crimped onto said cord engages said oblique surface of said guide.

23. The system of claim 15 wherein said sash support extends around an outside surface of said spring cover.

24. The system of claim 23 wherein a sleeve is crimped on a free end of said cord, and a passageway in said sash support interlocks with said sleeve.

* * * * *